US005409386A

United States Patent [19]

Banakis et al.

[11] Patent Number: 5,409,386

[45] Date of Patent: Apr. 25, 1995

[54] SURFACE MOUNT ELECTRICAL CONNECTOR AND TERMINAL THEREFOR

[75] Inventors: Emanuel G. Banakis, Naperville; Charles S. Galauner, St. Charles; Brian G. Krause, Arlington Heights; Susan M. Reed, Naperville, all of Ill.

[73] Assignee: Molex Incorporated, Lisle, Ill.

[21] Appl. No.: 108,412

[22] Filed: Aug. 18, 1993

[51] Int. Cl.[6] ..... H01R 23/72

[52] U.S. Cl. ..... 439/83; 439/567; 439/884

[58] Field of Search ..... 439/78, 83, 876, 884, 439/567

[56] References Cited

U.S. PATENT DOCUMENTS

| | | | |
|---|---|---|---|
| 3,288,915 | 11/1966 | Hatfield | 439/43 |
| 4,577,923 | 3/1986 | Stipanuk et al. | 439/83 |
| 4,955,820 | 9/1990 | Yamada et al. | 439/83 |
| 5,057,027 | 10/1991 | Yamada et al. | 439/83 |
| 5,073,118 | 12/1991 | Grabbe et al. | 439/71 |

FOREIGN PATENT DOCUMENTS

| | | | |
|---|---|---|---|
| 0450770 | 11/1991 | European Pat. Off. . | |
| 63-269466 | 11/1988 | Japan | 439/83 |

OTHER PUBLICATIONS

IBM Technical Disclosure Bulletin, vol. 21, No. 12, May 1979.

*Primary Examiner*—Neil Abrams
*Attorney, Agent, or Firm*—A. A. Tirva

[57] ABSTRACT

An electrical connector is provided for surface mounting on a printed circuit board and includes a dielectric housing having a mating face and a surface mounting face. The mating face includes a mating cavity. The surface mounting face includes a terminal-receiving passageway communicating with the cavity. A terminal is mounted on the housing, the terminal being stamped and formed of sheet metal material in a T-shaped configuration defining a trunk portion and a cross portion. The trunk portion extends through the passageway and projects into the mating cavity of the housing to provide a male terminal pin therein. The cross portion is exposed at the surface mounting face of the housing for contacting a circuit trace on the printed circuit board.

3 Claims, 3 Drawing Sheets

SURFACE MOUNT ELECTRICAL CONNECTOR AND TERMINAL THEREFOR

FIELD OF THE INVENTION

This invention generally relates to the art of electrical connectors and, particularly, to surface mount connectors having terminals surface connected to a printed circuit board, as by soldering.

BACKGROUND OF THE INVENTION

A variety of electrical connectors are designed for surface mounting to a printed circuit board by soldering lead wire terminals of the connectors to circuit traces on the surface of the printed circuit board. Conventional soldering methods are not used, but reflow soldering methods are used for mounting the terminals to the board.

As for the connectors themselves, the surface mount connectors often are of a receptacle-type, and a plug-type connector is mated with the surface mounted receptacle connector. The plug connector may be terminated to lead wires, or the plug connector also may be surface mounted to a second printed circuit board whereby, when the plug and receptacle connectors are mated, an electrical connection is made between two different circuit boards. Of course, other interconnecting systems are contemplated by the invention.

One of the problems often encountered with electrical connectors of the character described above concerns the design of the connector terminals. Problems continue to arise due to the ever-increasing miniaturization of the electronic circuit within which surface mount connectors most often are used. The terminals usually are stamped from sheet metal material and formed or bent into a desired configuration. For instance, a terminal may be stamped or formed into an L-shaped configuration, with one leg of the "L" forming a male terminal pin in the connector housing, and the other leg forming the surface mount portion of the terminal for soldering to a circuit trace on the printed circuit board. If a plurality of such terminals are mounted to the connector housing in a common orientation, a force imbalance is created, particularly in a single terminal row connector. Therefore, adjacent terminals are alternatingly oriented or are placed on alternate sides of the connector to give the connector stability on the printed circuit board. These requirements increase the manufacturing and assembly costs of the connectors.

Other surface mount terminals are assembled to a connector housing, and then formed by secondary bending operations. Again, these additional fabricating steps increase the costs of the connectors.

This invention is directed to solving these problems by providing an improved surface mount terminal stamped and formed from thin sheet metal material, the terminal being symmetrical, more easy to assemble and less expensive to manufacture, with the terminal providing excellent board stability and requiring no secondary bending operations.

SUMMARY OF THE INVENTION

An object, therefore, of the invention is to provide a new and improved surface mount electrical connector and terminal therefor.

In the exemplary embodiment of the invention, an electrical connector is adapted for surface mounting on a printed circuit board. The connector includes a dielectric housing having a mating face and a surface mounting face. The mating face includes a mating cavity, and the surface mounting face includes a terminal-receiving passageway communicating with the cavity. A terminal is mounted on the housing and includes a terminal portion projecting into the mating cavity and a contact portion exposed at the surface mounting face for contacting a circuit trace on the printed circuit board.

The invention contemplates an improvement wherein the terminal is stamped and formed of sheet metal material in a T-shaped configuration defining a trunk portion providing the terminal portion and a cross portion providing the contact portion. The trunk portion extends through the passageway in the surface mounting face of the housing and into the cavity in the mating face of the housing to provide a male terminal therein. The cross portion of the terminal is exposed at the surface mounting face of the housing for contacting the circuit trace on the circuit board.

As disclosed herein, both the trunk portion and the cross portion of the T-shaped terminal has a generally channel-shaped cross section. The terminal is symmetrical and can be assembled to the housing in a common orientation along an elongated row of terminals, without requiring any alternate orientations between adjacent terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
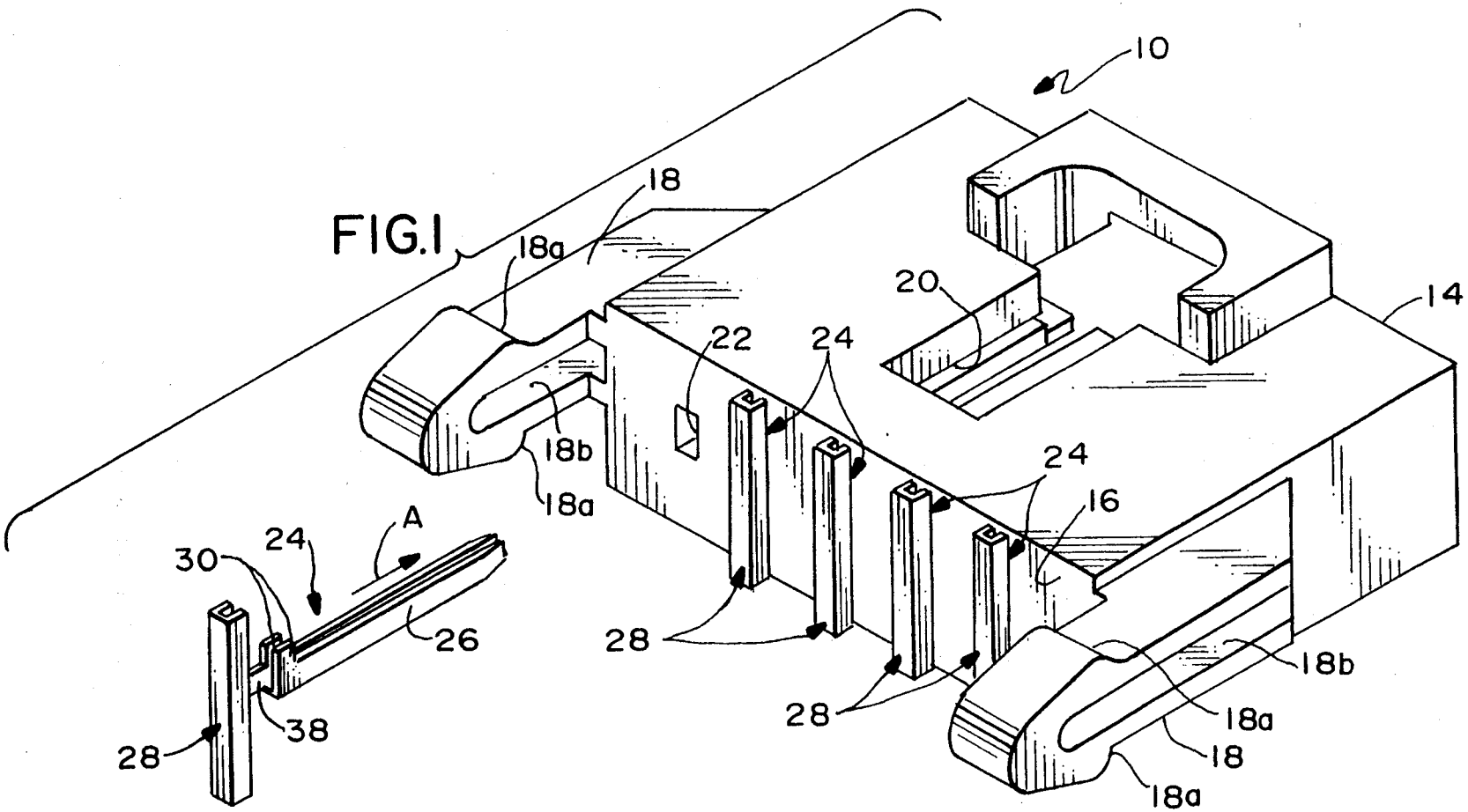
FIG. 1 is a bottom perspective view of a surface mount electrical connector embodying the concepts of the invention, with one of the terminals isolated therefrom to facilitate the illustration.
Figure 2:
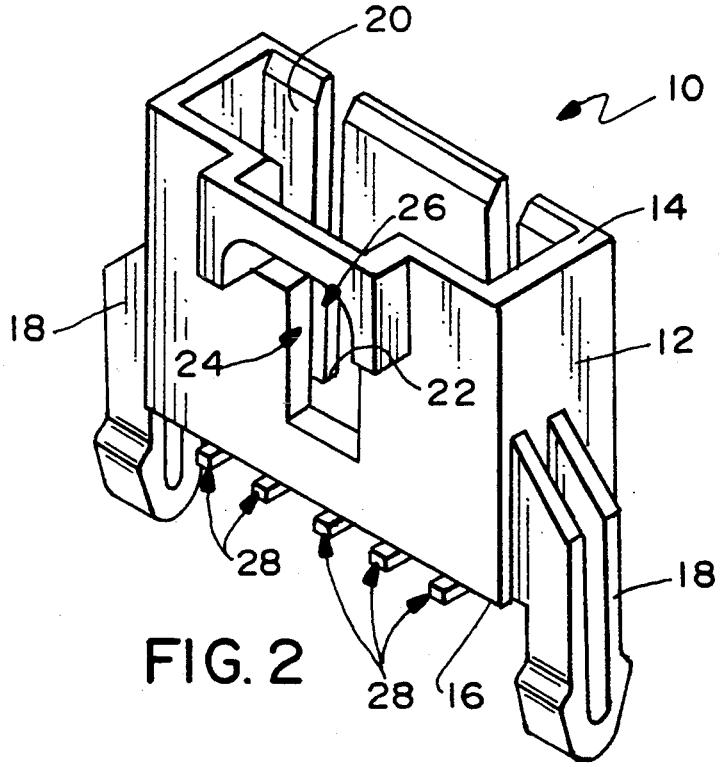
FIG. 2 is a top perspective view of the electrical connector.

Referring to the drawings in greater detail, and first to FIGS. 1 and 2, the invention is embodied in an electrical connector, generally designated 10, for surface mounting on a printed circuit board (not shown). The connector includes a dielectric housing 12 having a mating face 14 and a surface mounting face 16. The housing is unitarily molded of dielectric material, such as plastic or the like, and includes a pair of end board-locks or pegs 18 for insertion into appropriate locking holes in the printed circuit board. Whereas surface mounting face 16 will face the printed circuit board having circuit traces thereon, pegs 18 have hook or shoulder portions 18*a* for engaging the opposite side of the circuit board. The pegs are slotted, as at 18*b*, so that the pegs collapse inwardly when inserted through their respective holes in the circuit board, and the hook portions 18*a* snap back outwardly to engage the opposite side of the board to lock the connector to the board at least during a reflow soldering operation, as described hereinafter.

Mating face 14 includes a mating cavity 20 as seen best in FIG. 2. Therefore, housing 14 defines a receptacle-type connector 10 for receiving a complementary mating plug-type connector (not shown). Surface mounting face 16 includes a plurality of terminal-receiving passageways 22 communicating with cavity 20. In the embodiment of connector 10 shown in the drawings, five passageways 22 are oriented in a single row for receiving a single row of terminals described below.

A plurality of terminals, generally designated 24, are mounted on connector housing 12. Each terminal includes a terminal portion, generally designated 26, and a contact portion, generally designated 28. The terminals are assembled to the connector housing in the direction of arrow "A" (FIG. 1). Specifically, terminal portions 26 are inserted into passageways 22 from the surface mounting face 16, or bottom, of the connector housing until contact portions 28 abut against the surface mounting face. In this position, terminal portions 26 project into cavity 20 as best seen in FIG. 2, whereupon the terminal portions define male terminal pins for connector 10. Contact portions 28 provide soldering feet for the terminals, as best seen in FIG. 1, whereupon the contact portions or feet can be reflow soldered to appropriate circuit traces on the surface of the printed circuit board.

According to a feature of the invention, terminals 24 are formed of sheet metal material in a T-shaped configuration as best seen by the isolated terminal in FIG. 1. The T-shaped configuration defines a trunk portion providing the terminal portion 26 of each terminal, and a cross portion providing the contact portion 28 of each terminal. The terminals are substantially symmetrical, except for a pair of stabilizing tabs 30 (FIG. 1), and, therefore, the terminals can be inserted into passageways 22 in either of 180° opposite directions in relation to the orientations in FIGS. 1 and 2.

Figure 3:
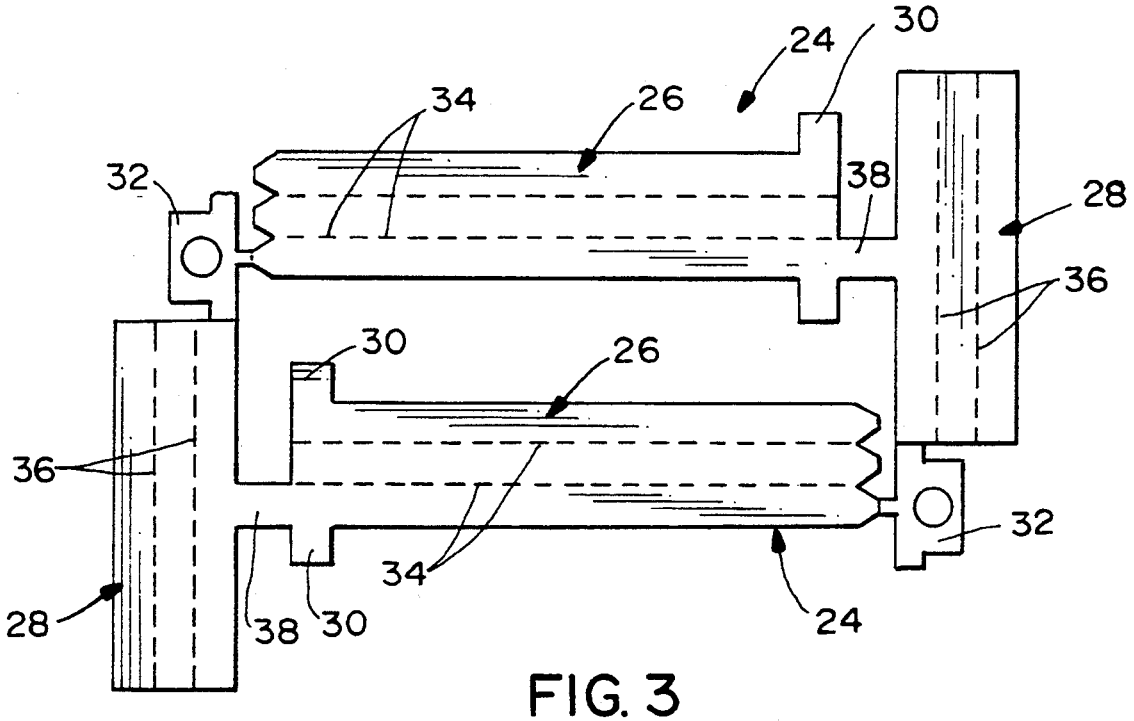
FIG. 3 is a fragmented plan view of a blank of sheet metal material from which the terminals of the invention are formed.
Figure 4:
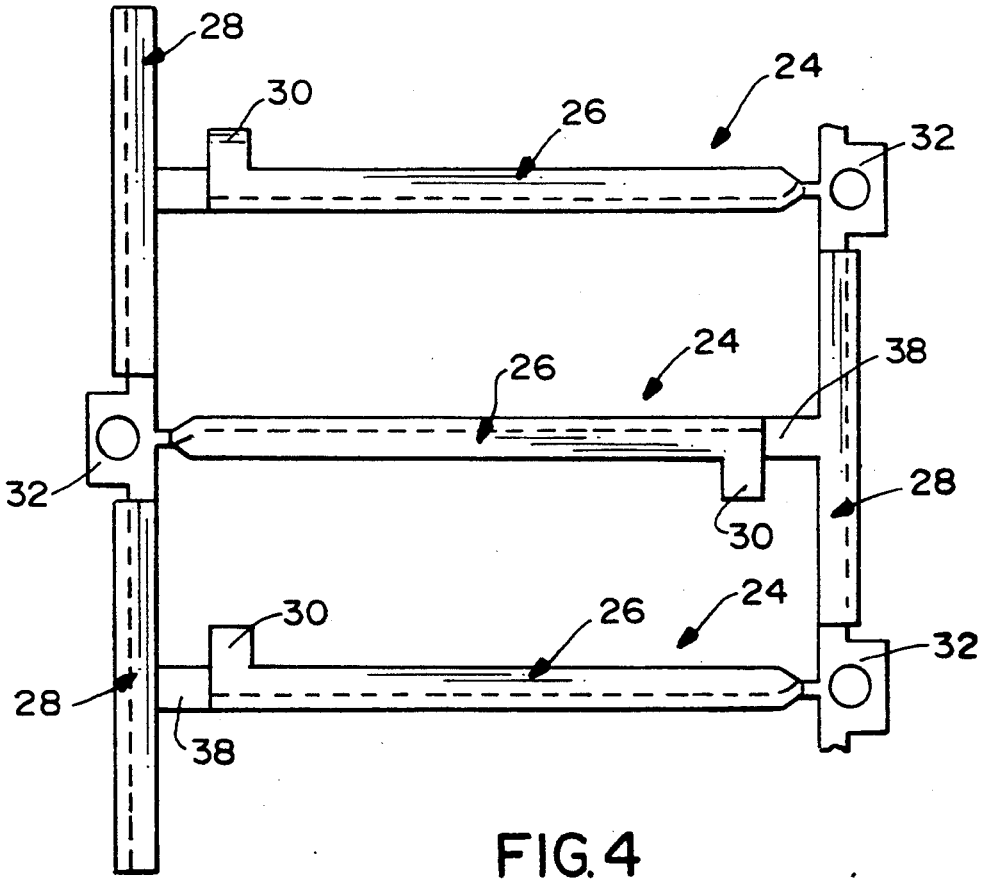
FIG. 4 is a view similar to that of FIG. 3, with the terminals in their formed configuration but still remaining attached to the carrier webs of the sheet metal material.

FIGS. 3 and 4 show how terminals 24 can be stamped and formed from a continuous strip of sheet metal material. Specifically, FIG. 3 shows a blank having been stamped from a continuous strip of sheet metal material which still includes portions 32 of the carrier webs for indexing the material through a stamping and forming machine. The initial stamped configurations of a pair of terminals 24 already can be seen in a flat condition, with terminal portions 26 and contact portions 28 of the terminals already apparent.

The flat stamped blank shown in FIG. 3 then is fed to a forming machine or station wherein terminal portions 26 are formed along bend lines 34 (FIG. 3), and contact portions 28 are formed along bend lines 36, into channel-shaped configurations as seen in FIG. 4, with the stamped and now formed terminals 24 still connected to carrier web portions 32.

Figure 5:
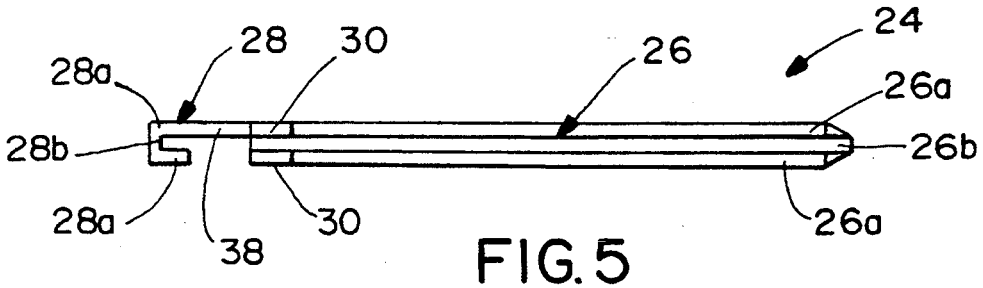
FIG. 5 is an edge elevational view of one of the completely formed terminals.
Figure 6:
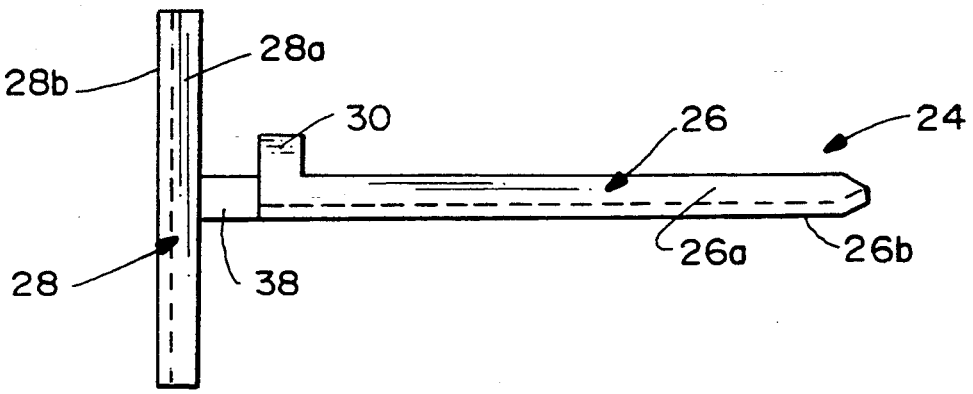
FIG. 6 is a side elevational view of the terminal shown in FIG. 5.

The stamped and formed strip shown in FIG. 4 then is fed to a cutting machine or station where the terminals are severed from carrier web portions 32 into their final configurations as shown in FIGS. 5 and 6. With terminal portions 26 of the terminals being formed in a channel-shape, each terminal portion is provided with a pair of side walls 26*a* and a base or bottom wall 26*b* of the channel configuration. Likewise, each contact portion 28 is formed by a pair of side walls 28*a* joined by a base or bottom wall 28*b*. The terminal portion and contact portion of each terminal are joined by a flat metal tab 38 which is integral with and interconnects one side wall 26*a* of the terminal portion and one side wall 28*a* of the contact portion in a common plane. The terminals now are in condition for insertion into connector housing 12 in the direction of arrow "A" (FIG. 1), as described above.

The terminal portions 26 and the contact portions 28 of the terminals are formed into channel-shaped structures to provide structural rigidity to the portions, which is a well known design feature when working with thin materials, and also to increase the surface contact areas of the terminal and contact portions ensuring good electrical contacts between the terminal portions and mating terminals and the contact portions and conductive areas on a printed circuit board. While a T-shaped terminal with mating surface contact areas can be manufactured by only stamping the terminal from sufficiently thick sheet of metal, the stamping only process will result in a large amount of wasted material. This can be best seen by looking at FIG. 4 and considering the terminal 24 shown in the center of the Figure as being stamped from a thick sheet of metal and comparing it to the stamped but not yet formed terminal shown in FIG. 3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for surface mounting on a printed circuit board, including a dielectric housing having a mating face and a surface mounting face, the mating face including a mating cavity, the surface mounting face including a terminal-receiving passageway communicating with the cavity, and a terminal mounted on the housing and including a terminal portion projecting into the mating cavity and a contact portion exposed at the surface mounting face for contacting a circuit trace on the printed circuit board, wherein the improvement comprises:

said terminal being stamped and formed of a thin continuous sheet metal material in a T-shaped configuration defining a trunk portion having a generally channel-shaped cross section providing said terminal portion and a cross portion having a generally channel-shaped cross section providing said contact portion, the trunk portion extending through the passageway into the cavity to provide a male terminal therein, and the cross portion being exposed at the surface mounting face for contacting the circuit trace on the printed circuit board.

2. An electrical connector terminal fabricated of stamped and formed thin sheet metal material, comprising a trunk portion and a cross portion defining a T-shaped configuration, the trunk portion having a generally channel-shaped cross section and providing a male terminal pin, and the cross portion having a generally channel-shaped cross section and providing a surface mounting foot.

3. The electrical connector terminal of claim 2 wherein the channel-shaped trunk portion is defined by a pair of side walls and a bottom wall, the channel-shaped cross portion is defined by a pair of side walls and a bottom wall, and one side wall of the trunk portion and one side wall of the cross portion are joined in a coplanar configuration by a flat metal tab portion.

* * * * *